US005285889A

United States Patent [19]

McDonald

[11] Patent Number: 5,285,889

[45] Date of Patent: Feb. 15, 1994

[54] ATTACHMENT MEMBER FOR CONVEYOR CHAIN AND TROLLEY ASSEMBLY

[75] Inventor: Clayton C. McDonald, Howell, Mich.

[73] Assignee: Jervis B. Webb Company, Farmington Hills, Mich.

[21] Appl. No.: 977,147

[22] Filed: Nov. 16, 1992

[51] Int. Cl.[5] ..... B65G 17/32

[52] U.S. Cl. ..... 198/687; 198/733

[58] Field of Search ..... 198/683, 687, 731, 733, 198/838, 845; 104/172.3-172.5

[56] References Cited

U.S. PATENT DOCUMENTS 2,101,951 12/1937 McInnis ..... 198/687
4,210,238 7/1980 Frost et al. ..... 198/687
4,228,738 10/1980 Forshee ..... 198/687
4,262,796 4/1981 McDonald ..... 198/687
4,480,743 11/1984 Dehne ..... 198/845

*Primary Examiner*—Joseph E. Valenza
*Attorney, Agent, or Firm*—Joseph W. Farley

[57] ABSTRACT

An attachment member for securing a pair of conveyor trolley brackets to a conveyor chain center link has a stem portion insertable through the center link between the trolley brackets to position recesses thereon in engagement with the center link sides and has a pair of integral end portions which overlap the opposite ends of the trolley brackets, which overlappingly engage the center link sides, and which form buffers for the ends of chain side bars connected to the center link. The attachment member is preferably formed of an impact noise suppressing material such as nylon.

10 Claims, 2 Drawing Sheets

ATTACHMENT MEMBER FOR CONVEYOR CHAIN AND TROLLEY ASSEMBLY

This invention relates to an improved attachment member for a conveyor chain and trolley assembly employed in endless chain conveyors.

A conventional conveyor chain is formed by alternative center links and pairs of side bars connected together by chain pins, and each center link has an open central position defined by a pair of parallel sides and arcuate ends, the parallel sides extending longitudinally and being spaced apart transversely of the chain. A trolley consists of a pair of brackets each having an arm to which a wheel is attached and a base insertable in the open central portion of a center link. Locating means, such as channel-shaped grooves on the trolley bracket bases, engage the sides of the center link when an attachment member is inserted between and connected to the trolley bracket bases. Conveyor chain and trolley assemblies of this general type are disclosed in my prior U.S. Pat. No. 4,262,796.

The present invention provides an attachment member for securing a pair of trolley bracket bases, having opposite longitudinally spaced ends, to a conveyor chain center link having an open central portion defined by a pair of parallel longitudinal extending transversely spaced sides and arcuate ends, the trolley bracket bases being insertable through the open central portion of the center link and having means for engagement with the center link sides. The attachment member comprises a stem portion insertable in the open central portion of the center link between the pair of trolley bracket bases for positioning said engagement means in engagement with the center link sides. The attachment member further comprises a pair of end portions formed integrally with the stem portion and spaced apart longitudinally a distance greater than the distance between the opposite ends of the trolley bracket bases. These end portions project transversely to each side of the stem portion into overlapping relation with the ends of the trolley bracket bases.

Preferably, the end portions of the attachment member each have a T-shaped transverse configuration formed by a leg and a head extending transversely to each side thereof, the leg being insertable between the sides of the center link, and the head having shoulders overlappingly engageable with the sides of the center link. The head has an end face which forms a buffer for an end of one of a pair of chain side bars connected to the center link; and, the leg is provided with a continuation of the end face adapted to project from the open central portion of the center link and form a buffer for an end of the other of the pair of chain side bars.

Another preferred feature is that the heads of the end portions of the attachment member include projections extending toward each other into overlapping relation with surfaces of the trolley bracket bases which intersect the end faces thereof, and which are preferably obliquely converging surfaces engageable by correspondingly oblique locating faces on the projections of the heads.

The attachment member of the invention is preferably formed of an impact resistant, noise suppressing material such as nylon. When such an attachment member is inserted between and connected to a pair of trolley bracket bases located in the open central portion of a chain center link, the opposite ends of the bases are enclosed by the end portions of the attachment member, the center link sides are overlappingly engaged by the heads of the end portions, and the end faces of the end portions act as buffers for pairs of chain side bars connected to the center link. The attachment member thereby acts to limit relative longitudinal movement between the trolley bracket bases and the center link, between the center link and pairs of side bars connected thereto; and, to suppress the noise resulting from such relative movements.

Other features and advantages of the invention will appear from the description to follow of the embodiment shown in the accompanying drawings.

DETAILED DESCRIPTION

Figure 2:
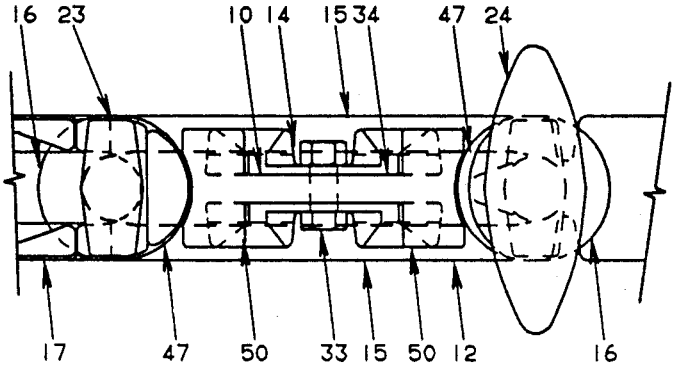
FIG. 2 is a top plan view of FIG. 1, the wheel supporting portion of the trolley being omitted.
Figure 1:
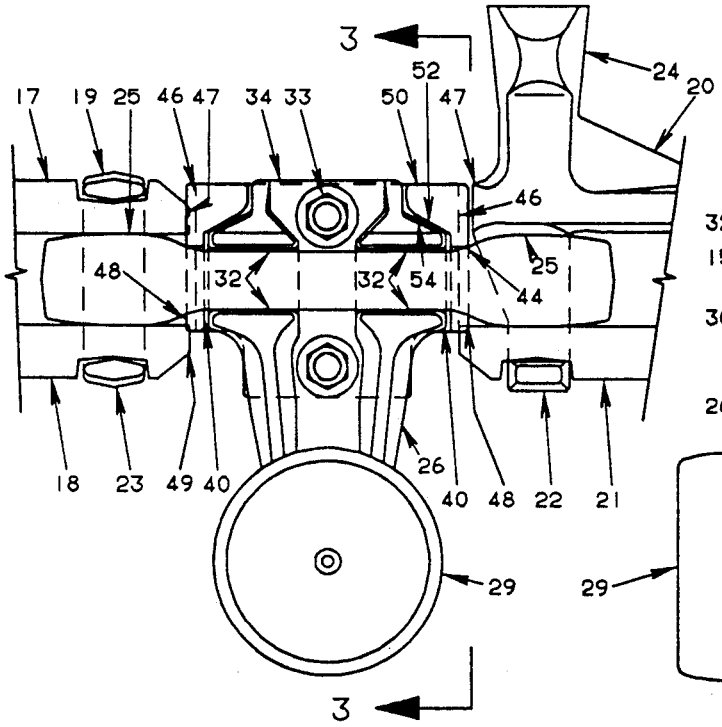
FIG. 1 is a side elevation showing a conveyor trolley connected to a center link of a conveyor chain by the attachment member of the invention.
Figure 3:
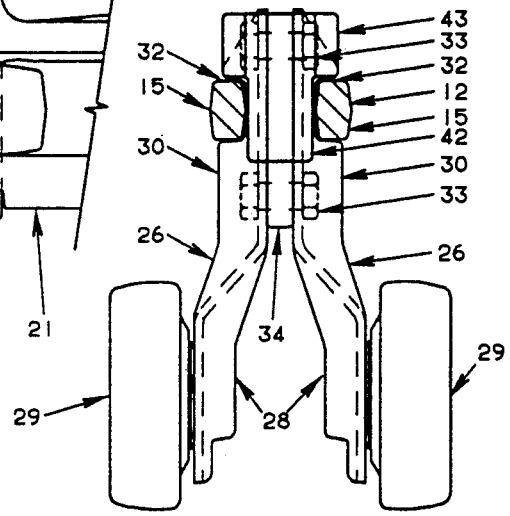
FIG. 3 is a sectional elevation taken substantially as indicated by the line 3—3 of FIG. 1.

FIGS. 1–3 illustrate a conveyor chain and trolley assembly incorporating an attachment member 10 of the present invention. The conveyor chain includes a center link 12 having an open central portion 14 defined by a pair of parallel sides 15 and arcuate ends 16, a pair of side bars 17 and 18 connected to one end of the center link 12 by a chain pins 19, and another pair of side bars 20 and 21 connected to the other end of the center link 12 by a pin 22 forming part of the side bar 20 which includes a projecting pusher 24. The pusher 24 is engageable with dogs of a load carrier (not shown) as in a conventional power and free type of conveyor. As shown in FIG. 1, side bar engaging portions 25 of the center link 12 adjacent to the ends thereof have an increased depth for retaining the chain pin heads 23 in engagement with the side bars.

The trolley consists of a pair of trolley brackets 26 each having an arm 28 to which a wheel 29 is attached, and a base 30 which is insertable through the open central portion 14 of the center link 12. Locating means, such as channel-shaped grooves 32 (FIG. 3) on the bases 30 are engageable with the center link sides 15 when the attachment member 10 is inserted between and connected to the bases 30 by bolts 33.

Figure 6:
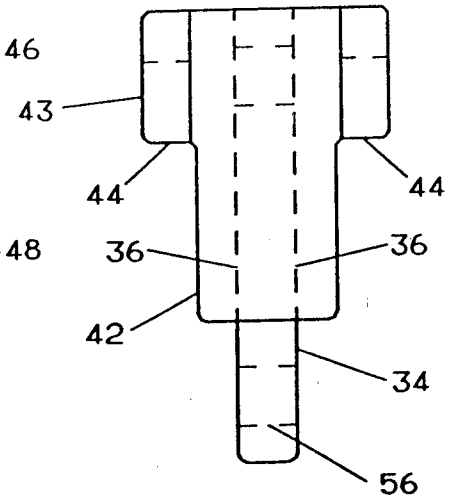
FIG. 6 is an end elevation of the attachment member of FIG. 4.
Figure 4:
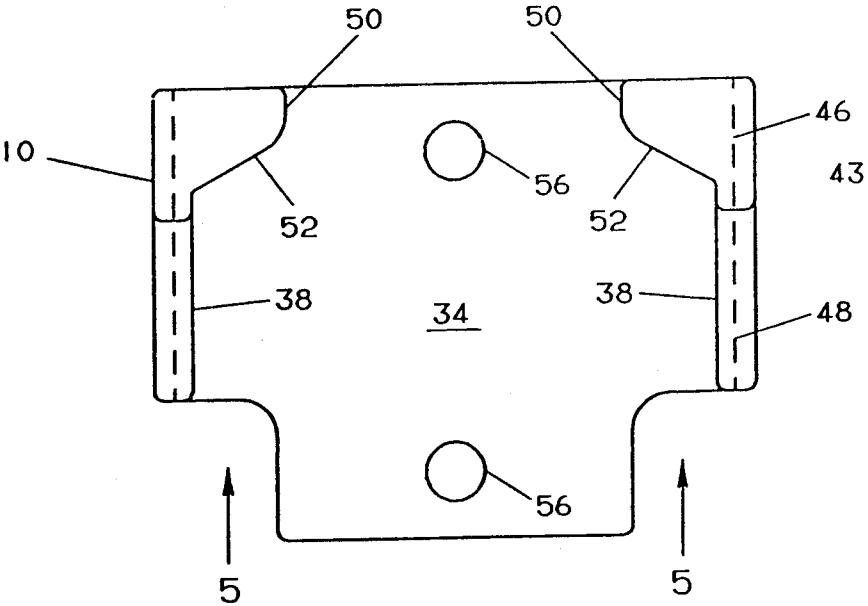
FIG. 4 is a side elevation of the attachment member of the invention.
Figure 5:
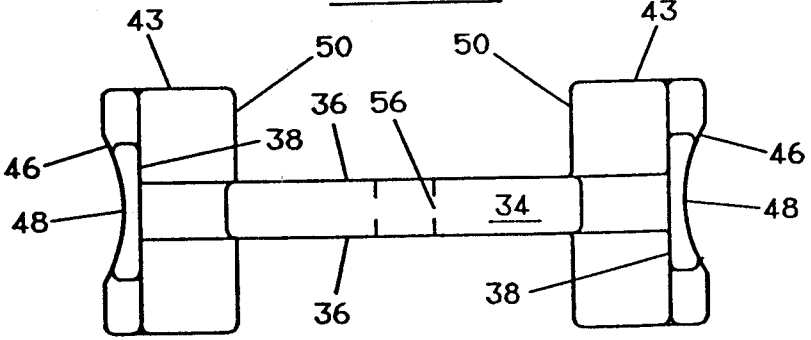
FIG. 5 is a plan view taken as indicated by the arrows 5—5 of FIG. 4.

Referring to FIGS. 4–6, the attachment member 10 comprises a stem portion 34 having parallel, oppositely facing side surfaces 36. The stem portion 34 is insertable in the open central portion 14 of the center link 12 with the side surfaces 36 extending parallel to the center link sides 15 between the trolley bracket bases 30, thereby positioning their locating grooves 32 in engagement with the center link sides 15 as shown in FIGS. 1–3.

Formed integrally with the stem portion 34 is a pair of end portions 38 which are spaced apart longitudinally a distance greater than the distance between the opposite end faces 40 of the trolley bracket bases 30. Each of the end portions 38 projects transversely to either side of the stem portion, outwardly of the side surfaces 36, and is positionable in overlapping relation with one pair of the end faces 40.

Each of the end portions 38 has a transverse T-shaped configuration (FIG. 6) formed by a leg 42 and a head 43 having shoulders 44 extending transversely to either side of the leg 42. The leg 42, as best shown in FIG. 3 is insertable between and is engageable with the sides 15 of the center link 12; the head shoulders 44 are overlappingly engageable with the center link sides 15 at the transition where their depth increases to the side bar engaging portions 25 of the center link. The head 43 also has an end face 46 which forms a buffer for an end 47 of one side bar of a pair of the side bars connected to the center link 12, i.e., either the side bar 17 or the side bar 20. The leg 42 preferably projects from the open central portion 14 of the center link 12 and has a continuation 48 of the end face 46, which continuation end face 48 forms a buffer for an end 49 of the other side bar of a pair, i.e., the side bar 18 or the side bar 21.

The heads 43 of the attachment member 10 include projections or caps 50 which extend toward each other and which are provided with obliquely converging locating faces 52. As best shown in FIG. 1, these projections extend into overlapping relation with surfaces 54 of the trolley bracket bases 30 intersecting the end faces 40, the surfaces 54 being obliquely converging and engageable by the correspondingly oblique locating faces 52. Such engagement aids in aligning fastener receiving apertures 56 provided on the stem portion 34 of the attachment member with corresponding apertures of the trolley bracket bases for insertion of the bolts 33.

The attachment member 10 is preferably injection molded of a suitable plastic material, e.g., nylon, having impact resistance and sound deadening or noise suppressing properties. An attachment member 10, made of such a material and used in the conveyor chain and trolley assembly of FIGS. 1-3, results in important advantages. Relative longitudinal movement between the center link 12 and the trolley brackets 26 is limited by the engagement of the shoulders 44 of the attachment member with the center link sides at their transitions to the increased depth of the side bar engaging portions 25, as best shown in FIG. 1. Relative longitudinal movement between the center link 12 and the side bars 17, 18 and 20, 21 connected thereto is limited by the buffers provided by the end faces 46, 48 of the attachment member, and contact between the side bar ends and the trolley brackets is prevented. The noise that would ordinarily be produced by such relative movements is suppressed by the plastic material—a result that is becoming increasingly desired.

I claim:

1. An attachment member for securing a pair of trolley bracket bases having opposite longitudinally space ends to a conveyor chain center link having an open central portion defined by a pair of parallel longitudinally extending transversely spaced sides and arcuate ends, said trolley bracket bases being insertable through said open central portion and having means for engagement with said center link sides, said attachment member comprising:

a stem portion insertable in said open central portion between said pair of trolley bracket bases for positioning said engagement means in engagement with said center link sides, and;

a pair of end portions formed integrally with said stem portion and spaced apart longitudinally a distance greater than the distance between said opposite ends of said trolley bracket bases, said end portions projecting transversely to each side of said stem portion into overlapping relation with the ends of the trolley bracket bases, each of said pair of end portions having a T-shaped transverse configuration formed by a leg and a head extending transversely to each side thereof, said leg being insertable between said center link sides, and said head having shoulders overlappingly engageable with said center link sides at a transition to an increase in the depth thereof.

2. An attachment member according to claim 1 formed of an impact resistant, noise suppressing material.

3. An attachment member according to claim 1 wherein said head has an end face forming a buffer for an end of one of a pair of chain side bars connected to said center link.

4. An attachment member according to claim 3 wherein said leg projects from said open central portion of said center link and has an end face forming a buffer for an end of the other of said pair of chain side bars.

5. An attachment member according to claim 1 formed of an impact resistant, noise suppressing plastic material.

6. An attachment member according to claim 1 wherein the heads of said pair of end portions include projections extending toward each other into overlapping relation with surfaces of said trolley bracket bases intersecting said ends thereof.

7. An attachment member according to claim 6 wherein said surfaces of said trolley bracket bases are obliquely converging, and said projections are provided with correspondingly oblique locating faces engageable therewith.

8. An attachment member according to claim 7 wherein fastener receiving means are provided on said stem portion, said fastener receiving means being alignable with corresponding means on said trolley bracket bases by engagement between said obliquely converging surfaces thereof and said oblique locating faces of said projections.

9. An attachment member according to claim 8 wherein the heads of said pair of end portions have oppositely directed end faces each forming a buffer for an end of one of a pair of chain side bars connected to said center link, and the legs of said pair of end portions are provided with continuations of said end faces each adapted to project from said open central portion of said center link and form a buffer for an end of the other of said pair of chain side bars.

10. An attachment member according to claim 9 formed of an impact resistant noise suppressing plastic material.

* * * * *